US007842919B2

(12) United States Patent
Shiokawa

(10) Patent No.: US 7,842,919 B2
(45) Date of Patent: Nov. 30, 2010

(54) Q-POLE TYPE MASS SPECTROMETER

(75) Inventor: Yoshiro Shiokawa, Tokyo (JP)

(73) Assignee: Canon Anelva Corporation, Kanagawa (JP)

( * ) Notice: Subject to any disclaimer, the term of this patent is extended or adjusted under 35 U.S.C. 154(b) by 149 days.

(21) Appl. No.: 12/071,696

(22) Filed: Feb. 25, 2008

(65) Prior Publication Data

US 2008/0251717 A1 Oct. 16, 2008

Related U.S. Application Data

(63) Continuation of application No. 11/592,330, filed on Nov. 3, 2006, now abandoned, which is a continuation of application No. 10/887,910, filed on Jul. 12, 2004, now abandoned, which is a continuation of application No. 09/824,211, filed on Apr. 3, 2001, now abandoned.

(30) Foreign Application Priority Data

Apr. 3, 2000 (JP) ..... 2000-101056

(51) Int. Cl.
*H01J 49/00* (2006.01)
*H01J 49/28* (2006.01)

(52) U.S. Cl. ..... 250/290; 250/281; 250/292; 250/293; 250/296

(58) Field of Classification Search ..... None
See application file for complete search history.

(56) References Cited

U.S. PATENT DOCUMENTS

| | | | |
|---|---|---|---|
| 4,931,640 | A | 6/1990 | Marshall et al. |
| 4,959,543 | A | 9/1990 | McIver et al. |
| 5,426,301 | A | 6/1995 | Turner |
| 5,572,035 | A | 11/1996 | Franzen |
| 5,783,824 | A | 7/1998 | Baba et al. |
| 6,111,250 | A | 8/2000 | Thomson et al. |
| 6,182,831 | B1 | 2/2001 | Scheidermann et al. |
| 6,753,523 | B1 | 6/2004 | Whitehouse et al. |

*Primary Examiner*—David A Vanore
(74) *Attorney, Agent, or Firm*—Wenderoth, Lind & Ponack, L.L.P.

(57) ABSTRACT

A Q-pole type mass spectrometer can be used under a high-pressure atmosphere of more than 0.1 Pa. The Q-pole type mass spectrometer can analyze the mass of gas molecules continuously, and can separate mass properly even if an ion is injected at high speed in order to reduce the influence of an end electric field near an end face (fringing) of the Q-pole. The motion of the ions to be measured in the diameter direction is independent of the motion of ions in the axial direction within the Q-pole region of the Q-pole type mass spectrometer. In the Q-pole type mass spectrometer installed in a reduced pressure atmosphere, the motion of ions to be measured in the axial direction advancing from an ion source toward a collector, is controlled within the Q-pole region so as to separate the mass of the ions to be measured by Coulomb force generated by a quadrupole high-frequency electric field in the diameter direction.

4 Claims, 9 Drawing Sheets

DETECTION MODE (INTERMITTENT OPERATION)

CHANGE OF INTENSITY OF MAGNETICFIELD AND INDUCED ELECTERICFIELD

ACCUMULATION MODE

DETECTION MODE (INTERMITTENT OPERATION)

Q-POLE TYPE MASS SPECTROMETER

This is a Continuation application of U.S. patent application Ser. No. 11/592,330, filed Nov. 3, 2006 now abandoned, which is a Continuation Application of U.S. patent application Ser. No. 10/887,910, filed Jul. 12, 2004 now abandoned, which is a Continuation Application of U.S. patent application Ser. No. 09/824,211, filed Apr. 3, 2001 now abandoned.

BACKGROUND OF THE INVENTION

1. Field of the Invention

The present invention relates to a mass spectrometer for measuring the mass of a gas molecule in a reduced-pressure (vacuum) atmosphere. More particularly, the present invention relates to a mass spectrometer which can be used in a relatively high pressure atmosphere of 0.1 Pa or more, a small-size mass spectrometer capable of measuring a high-mass molecule at a high sensitivity, and a mass spectrometer capable of measuring an ultra fine amount of gas.

2. Prior Art

A Q-pole type mass spectrometer, called mass filter or quadrupole type mass analyzer, is capable of carrying out high-sensitivity measurement in a wide dynamic range with a small and simple structure under easy control. Therefore, the Q-pole type mass spectrometer is a general mass spectrometer for measuring the mass of a gas molecule.

The Q-pole type mass spectrometer is comprised of an ion source for ionizing gas, a Q-pole for carrying out mass separation and a collector for detecting mass-separated ions. The Q-pole type mass spectrometer is actuated in a low pressure atmosphere of 0.01 Pa or less.

FIG. 9 shows a conventional Q-pole type mass spectrometer under ordinary operating condition.

Four Q-poles 1 (poles) are disposed in parallel at a high precision of micro order, and ordinarily the length is 100 to 300 mm while an interval between opposing poles is 5 to 10 mm. A high-frequency voltage V of 1 to 5 MHz and DC voltage U are applied to each pole. Accurately speaking, the same V, U voltages are applied to opposing poles and −V, −U voltages are applied to neighboring poles. Consequently, a specific quadrupole electric field (bipolar electric field) is formed in the diameter direction.

Ions existing near the axis of this quadrupole electric field are vibrated in the diameter direction by Coulomb force and ions except for those of a mass and electric charge determined by the V, U values are expelled out of the axis.

On the other hand, with respect to the potential in the axial direction, the potential is the same at any axial point so that there is no electric field (rate of potential position change) in the axial direction. Thus, no Coulomb force is generated on ion in the axial direction. The reason why the same potential is produced at any axial point is that the four poles are united, the united pole has the same potential, and the voltage does not change depending on any position in the axial direction of the pole. Thus, the same electric field is formed in a section vertical to the axis in any axial direction so that no electric field is generated in the axial direction.

Usually, the voltage of the ion source is raised above the potential of the Q-pole on the axis (center potential of the quadrupole electric field) by about 10 V and then the ion is advanced in the Q-pole at a speed (10 eV) corresponding to linear energy of 10 eV. At this time, with respect to the diameter direction, only an ion having a specific mass/charge continues to vibrate stably. Then only a specific ion passes the Q-pole so that it is detected by the collector and becomes a signal. The other ions which do not have the specific mass/charge are expelled halfway. Thus, the motion of ions in the diameter direction and the motion of ions in the axial direction are completely independent of each other in the Q-pole.

By changing the ratio between V and U, the mass/charge of the ion, which is to be measured, can be selected and an ion of about 1 to 1000 amu (atomic mass unit) can be measured. However, to separate the mass of an ion with mass number M amu with sufficient resolution, the ion needs to be vibrated at least 2 to 4 times $(M/0.5)^{0.5}$ in the Q-pole. That is, it needs to be vibrated 5 times at 2 amu, 30 times at 50 amu, 50 times at 100 amu and about 100 times at 300 amu.

Therefore, it is necessary that the time within which the ion to be measured passes through the Q-pole is longer than time required for this vibration.

The ion speed allowing mass separation to be achieved is determined by a relation between the length of the Q-pole and the high-frequency vibration number. For example, if the length of the Q-pole is 200 mm and the high-frequency vibration number is 2 MHz, the necessary vibration number in all mass ranges is satisfied at a speed of 15 eV. Therefore, the speed of an ion capable of achieving mass separation is about 15 eV max. and a speed of 5 to 10 eV is necessary to obtain sufficient resolution.

The Q-pole type mass spectrometer is used in an atmosphere of 0.01 Pa or less. If it is operated in a high-pressure atmosphere of 0.01 Pa or more, collisions between the atmospheric gas and the ion occurs so as to obstruct proper measurement. This will be described below.

The mean free path is an average distance in which an ion or the like can advance without any collision with the atmospheric gas. And the mean free path is in inverse proportion to the pressure (density) of the atmosphere. In a strict sense, the mean free path relates to the atmospheric gas, and the size, mass and speed of the ion, so that the mean free path depends on not only the pressure but also the kind of gas and ion speed. In an Ar (Argon) atmosphere of 0.1 Pa, the mean free path is about 120 mm for a He ion (4 amu), about 60 mm for a $CO_2$ ion (44 amu) and about 33 mm for a large ion of 300 amu.

If the mean free path of the ion is smaller than the length of the Q-pole, for example, and the atmospheric pressure is 1 Pa, the ion passing through the Q-pole always collides with the atmospheric gas, statistically speaking (on average). For simplification, it is assumed that the collision occurs front to front in the axial direction (although there are actually collision components in the diameter direction, they are offset by each other on average so that they can be omitted).

If the mass of an ion is larger than that of the atmospheric gas, the ion receives the pressure of the atmospheric gas upon collision so that the ion speed is largely reduced. Therefore, the ion speed in the axial direction drops each time a collision occurs and finally the ion is stopped in the Q-pole. However, there is no change in the vibration in the diameter direction. FIG. 10 shows this condition.

The deceleration rate decreases as the ratio of mass between ion and the atmospheric gas increases. That is, a heavy ion is not decelerated as much. On the other hand, if the mass of an ion is smaller than the atmospheric gas, the ion is repelled after a collision so that the ion advance direction is inverted. If the masses of an ion and the atmospheric gas are the same, the ion is stopped with a single collision. The change of the speed between before and after a collision is expressed by the following equation.

$$V_2=V_1(M_i-M_g)/(M_i+M_g)$$

where, $V_1$: ion speed before collision, $V_2$: ion speed after collision, $M_i$: mass of ion, $M_g$: mass of the atmospheric gas.

Anyway, deceleration including stop and retraction is generated by a collision with the atmospheric gas so that advance of an ion in the Q-pole is hampered. Thus, usually, the Q-pole type mass spectrometer is used under a pressure of 0.01 Pa or less in which the mean free path is longer than the length of the Q-pole.

Thus, for measurement of gas at a pressure of more than 0.01 Pa, it is requested to reduce the pressure in the region of the Q-pole type mass spectrometer by differential air discharge and to introduce the gas to be measured through an introducing pipe having a small conductance. With this complicated structure, there not only occurs a problem about cost and reliability, but there also occurs a problem in that the concentration of gas to be measured is reduced so that the sensitivity is deteriorated. Although in most cases, industrially speaking, the gas to be measured is at atmospheric pressure, differential air discharge has to be carried out through two or three stages. Thus, this is a serious problem.

Recently, an ultra small Q-pole type mass spectrometer which can be actuated in a high-pressure atmosphere of 0.1 to 1 Pa has been developed. Although, theoretically, this is the same as the ordinary Q-pole type mass spectrometer, the length of the Q-pole is shorter by about 10 mm (1/10 the ordinary type) so that mass separation is achieved in a shorter distance than the mean free path under 0.1 to 1 Pa. However, because the length of the Q-pole is short, the interval between the poles needs to be less than 1 mm and therefore the required positional accuracy of the Q-pole becomes very strict. Thus, currently, a sufficient performance cannot be achieved so that difficulty and cost of production increase.

On the other hand, the ordinary Q-pole type mass spectrometer has a serious fringing problem which deteriorates the sensitivity for a high-mass molecule. The fringing problem is generated because the electric field near an end face (fringing) of the Q-pole is weaker and disturbed more than near the center of the Q-pole. This is referred to as an end face electric field problem or end electric field problem. A specific ion, which is vibrated stably in the Q-pole having a normal electric field, turns to unstable traces and disperses in the fringing area, whereby the sensitivity is greatly reduced.

It has been known that while an influence of the entrance side (ion source side) of the Q-pole or entrance fringing region is very large, the exit side (collector side) or the exit fringing region has little influence. The reason is that mass separation is greatly affected if the injection direction and the position of an ion passing the entrance fringing region are deviated. But it is enough for the ion which passes the exit fringing region at least to enter the collector.

It is considered that the electric field is disturbed up to a distance equal to the pole interval outside and inside the Q-pole end face, so that it is considered that the fringing region becomes substantially twice the interval of the poles. Therefore, the Q-pole region in which the electric field is not disturbed is equal to a length obtained by subtracting the length of the fringing region from the length of the pole.

The influence of the fringing problem is increased proportionally to the vibration frequency in the fringing region. Thus, the degree of the bad influence is inversely proportional to the ion speed in the axial direction. That is, if the ion speed is slow, the time in which ion sojourns in the fringing region is prolonged, so that unstable vibration is repeated, thereby increasing the bad influence. It has been experimentally known that if the vibration in the fringing region is once or more, the bad influence is increased rapidly.

It is known that an ion having the same linear energy is slower if the mass thereof is increased, so that the fringing problem becomes very serious in the case of high mass. For example, if the length of the fringing region is 5 mm and the high-frequency vibration frequency is 2 MHz, when the ion speed is 5 eV, 15 eV and 30 eV, the vibration frequency in the fringing region is 0.5 times, 0.26 times and 0.2 times at 2 amu, 1.7 times, 0.98 times and 0.7 times at 28 amu, 2.3 times, 1.3 times and 0.9 times at 50 amu, 3.2 times, 1.7 times and 1 time at 100 amu, and 5.6 times, 3.2 times and 2.3 times at 300 amu. That is, the bad influence of the fringing problem appears at 28 amu or more at 5 eV and at 100 amu or more at 30 eV.

If the linear energy is increased, the sojourning time in the Q-pole is decreased so that the bad influence is reduced. However, the vibration frequency becomes short in the above mass separation so that a necessary resolution cannot be obtained. Thus, the linear energy of about 10 eV in which both the problems can be compromised is employed. However, under this condition, it has been known that the sensitivity drops to about 1/5 (one fifth) at 100 amu and about 1/100 (one hundredth) at 300 amu.

Conventionally, various methods have been considered as a countermeasure for the fringing problem. According to Japanese Patent Publication No. JP-B-40-17440, a Q-pole having plural segments each having different ratios between high-frequency voltage and DC voltage is employed. According to JP-B-40-17440, in the Q-pole on the injection side, by setting a large resolution, the fringing problem is reduced and by reducing the resolution successively, a required resolution can be obtained in a center pole. However, not only is the structure complicated, but there also occurs a new problem in that performance is deteriorated by a disturbance of the electric field between the Q-poles of respective segments. In JP-B-40-17440, although the Q-pole is divided into the respective segments, the potential on the axis of each Q-pole is the same. Therefore, the electric field in the axial direction on the axis is zero and the ion speed in the axial direction is constant.

According to Japanese Patent Publication No. JP-A-48-41791, a nozzle is disposed in the fringing portion. But there is a new problem JP-A-48-41791 in that the nozzle disturbs the electric field (data that it is 1/5 at 100 amu and 1/100 at 300 amu as the before described is a result of this nozzle system).

Instead of keeping the DC potential on the axis in the Q-pole at grounding potential, sometimes it is raised to 100 V while the potential of the ion source is kept at 110 V and the potential between the ion source and Q-pole is kept to 0 V. It is considered that an ion may pass the fringing region at a speed as high as 100 eV, so that a bad influence is reduced, and the ion may be decelerated in the Q-pole region and advance at a speed as low as 10 eV so that mass separation is carried out properly. This is the reason why the before mentioned combination of potential is adopted instead of keeping the DC potential on the axis in the Q-pole at grounding potential.

However, actually, this method has not produced any effect. There are two reasons for this. The first reason is that a large difference is generated between the potential on the axis in the Q-pole and the potential out of the Q-pole, so that the DC potential component is greatly disturbed whereby the bad influence of the fringing is further intensified. The second reason is that, correctly speaking, a position where the ion is decelerated is within the fringing region (near the ultimate end), but not within the Q-pole region. If the electric field exists in the axial direction the ion is decelerated and if the electric field in the axial direction is not completely uniform in a section vertical to the axis, a bad influence is produced. That is, that position is just the fringing region. Thus, under this method, the vibration frequency is not reduced within the fringing region. Particularly, this decelerating electric field is formed with symmetric electric fields comprised of the quadrupole electric field at the Q-pole and a uniform electric field (non electric field) outside of the Q-pole, so its section does not become uniform and the electric field is greatly disturbed.

Anyway, conventionally, there was no effective countermeasure for the fringing problem and there was not any Q-pole type mass spectrometer capable of measuring high-mass molecules at a high sensitivity.

In recent years, a three-dimensional quadrupole type mass spectrometer (named "ion trap"), which is similar to the Q-pole type mass spectrometer in its operation principle, has been developed for actual use. In an ion trap, ions are not mass-separated while traveling in a single direction like the Q-pole type mass spectrometer, but remain in the same region of the three-dimensional quadrupole for mass separation. However, the principle that only ions having specific mass/charge are detected by high-frequency electric field and DC electric field in the three-dimensional quadrupole is the same. These have been described in detail in Japanese Patent Publication No. JP-B-60-32310, Japanese Patent Publication No. JP-B-4-49219 and Japanese Patent Publication No. JP-B-8-21365.

In the ion trap, ions can be measured in a high-pressure atmosphere of 0.1 Pa because they do not have to be moved in the axial direction, and a high-mass gas can be measured without deterioration of the sensitivity because no fringing (end face) exists. Further, by a condensation function in which ions of a specific gas are accumulated and other ions are removed, an ultra small amount of gas can be measured.

But, in the ion trap, ions sojourn in the same region, so that a number of ions cannot be measured at the same time and its dynamic range is small owing to an influence of space charge. Further, in the ion trap, ion deposition and mass sweep are carried out alternately, so that complicated control is necessary and the ion source has no expandability.

In the ion trap, ions can be measured at a high pressure of 0.1 Pa. That is, even if an ion does not move in the axial direction, the ion is vibrated within the three-dimensional quadrupole, so that, practically speaking, a sufficiently long path exists in the ion trap. This path is longer than the mean free path under 0.1 Pa, and although the ion collides with the atmospheric gas many times there, mass separation is achieved without any problem. This indicates that even if the ion, which is vibrating in a stable condition, changes its path owing to collision with the atmospheric gas, it maintains stable vibration. This point is quite different from a magnetic field deflection type mass spectrometer in which, if an ion trace is changed halfway, a necessary initial condition is lost so that subsequent mass separation is completely impossible.

As a unit spectrometer using the same principle in use with a quadrupole electric field as the Q-pole type mass spectrometer, a quadrupole rail unit intended for non-contact holding and transportation of charged particles is available. There are some known methods. One is that the quadrupole electrode is tilted from a horizontal face so as to slide charged particles toward the center axis of the quadrupole, that is to say to slide charged particles in the axial direction downward by gravity. An other method is that an insulator charged with the same polarity as a particle is brought near the particle so as to move the particle in the axial direction by its reaction force.

In the method using gravity in the above described quadrupole rail unit, the mass of the particle (charged particle) is larger than a gas molecule. That is, the quadrupole rail unit is not intended for mass separation of a gas molecule, but is used for measurement of particles having a large mass or particles which are substance particles having a crystal structure. If this particle (charged particle) is an ionized gas molecule (ion), the time in which the ion passes the Q-pole region is extremely prolonged, so that it is never actually used as a measuring device.

In the method of using the reaction force against an insulator charged with the same polarity in the above described quadrupole rail unit, the charged particles injected into the Q-pole region must be pushed out of the Q-pole region by using a counter force of Coulomb force. As a result, the quadrupole electric field is inevitably disturbed so that proper mass separation is impossible. Further, according to this method, the driving mechanism is reciprocated along the Q-pole region so that the charged particle cannot be transported out of the Q-pole region. Therefore, this method is far from practical use as a mass spectrometer.

Although the quadrupole rail unit and the Q-pole type mass spectrometer use the same principle of using the quadrupole electric field, the quadrupole rail intended for mainly non-contact holding and transportation of large particles for investigation and the Q-pole type mass spectrometer intended for mainly continuous mass separation for measurement are completely different from each other in terms of application, function and structure. Therefore, the application of the particle transportation method by the quadrupole rail to the Q-pole type mass spectrometer is completely impossible from the viewpoints of performance and practical use.

Under a high-pressure atmosphere of more than 0.1 Pa in the conventional Q-pole type mass spectrometer, an ion collides with the atmospheric gas so that the speed in the axial direction is reduced to zero, so that it is stopped in the Q-pole region and thus is not detected by a collector.

There is a known method of using gravity force or a counter force by bringing an insulator charged with the same polarity as that of particle to be measured in the quadrupole electric field for transporting charged particles. But continuous mass separation for gas molecules can not be carried out by the known method.

If an ion is injected at high speed in order to reduce the influence of an end electric field near a Q-pole end face (fringing) which deteriorates the sensitivity of the Q-pole type mass spectrometer, the ion passes the Q-pole region at high speed, so that the necessary vibration frequency cannot be obtained and proper mass separation is not carried out.

Further, there is also a problem in that a condensation function cannot be carried out so that an ultra-small amount of gas cannot be measured.

SUMMARY OF THE INVENTION

For the present invention, it has been noticed that the motions of an ion in the diameter direction and in the axial direction within the Q-pole are completely independent of each other.

The before described problems are solved by controlling the motion of the ion in the axial direction by various methods for providing the ion with a force in the axial direction while maintaining the motion of ions in the diameter direction so that the conventional function of mass separation is maintained.

One aspect of the present invention is that, by applying a fresh force in the axial direction continuously or intermittently to an ion whose speed in the axial direction is reduced or decelerated such that it is almost stopped in the Q-pole region (the reduction of the speed in the axial direction of the ion and the deceleration within the Q-pole region are induced by a collision with the atmospheric gas), the ion is accelerated and kept advancing, so that the ion is detected by the collector.

Another aspect of the present invention is that, by applying a fresh force in the axial direction within the Q-pole region to an ion injected at a high speed in order to reduce a bad influence of the fringing problem, the ion is decelerated or decelerated, until it is almost stopped, so that proper mass separation is carried out.

A further aspect of the present invention is that, by providing a condensation function in which only an ion of a specific gas (an ultra-small amount of gas) is accumulated (kept to sojourn within the Q-pole region), while removing the other ions by adjusting the speed of the ion in the axial direction to almost zero within the Q-pole region, a process for injecting the accumulated specific gas (ultra-small amount of gas) to the side of the collector is executed intermittently.

The present invention employs the following means as means for controlling the motion of an ion in the axial direction.

1) Coulomb force generated by an electric field formed by four Q-poles composing the Q-pole type mass spectrometer, so constructed that four Q-poles have equal DC potentials except DC voltage U at the same position in the axial direction of each Q-pole of four Q-poles, while each Q-pole of the four Q-poles has different DC potentials depending on their positions in the axial direction.

2) Reaction force generated by a collision between the ion to be measured and the atmospheric gas.

3) Control of motion of ion to be measured in the Q-pole region in the axial direction is carried out by setting the length of the Q-pole, kind and pressure of the atmospheric gas, potential of the ion source and potential of the Q-pole on the axis so that the ion to be measured is capable of passing the Q-pole region without receiving an additional force in the axial direction within the Q-pole region.

4) Coulomb force generated by space charge formed in the Q-pole region by ion to be measured.

5) Lorentz force generated by high-frequency magnetic field synchronous with quadrupole high-frequency electric field applied in the diameter direction.

6) Electromagnetic induction force, generated by magnetic field changing in its intensity with the passage of time, applied in the diameter direction.

The above described respective means may be employed independently or in combination. For example, it is permissible to control the motion of the ion in the axial direction by only the Coulomb force generated by the electric field or control the motion of the ion in the axial direction by combining control by the electric field with control by the space charge.

According to the present invention, the motion of the ion to be measured is controlled within the Q-pole region by various methods in the axial direction, which is independent of the motion of the ion in the diameter direction. Mass separation under a high-pressure condition of more than 0.1 Pa is thereby enabled and, further, continuous mass analysis of gas molecule is also enabled.

Also, according to the present invention, an influence of the fringing problem can be reduced, and a high-mass gas can be measured at a high sensitivity. Further, an ultra-small amount of gas can be measured by condensing of specific ion.

The conventional ultra small Q-pole type mass spectrometer capable of being actuated under a high-pressure atmosphere indicated in the prior art in this specification requires strict accuracy of position because the interval of the Q-poles has to be smaller in proportion to the length thereof.

According to the present invention, the interval of the Q-poles may be the same as conventionally, that is, the same accuracy of position as that of the conventional Q-pole type mass spectrometer may be accepted.

Further, because the length of the Q-pole may be reduced to one of several parts of that of the conventional Q-pole type mass spectrometer, the same accuracy of position can be achieved tremendously easily. The problem with the accuracy in position of the Q-pole, which is a serious obstacle in terms of performance and cost in the conventional Q-pole type mass spectrometer, can be solved by the present invention.

DESCRIPTION OF THE PREFERRED EMBODIMENTS

Hereinafter, the preferred embodiments of the present invention will be described with reference to the accompanying drawings.

First Embodiment

Figure 1:
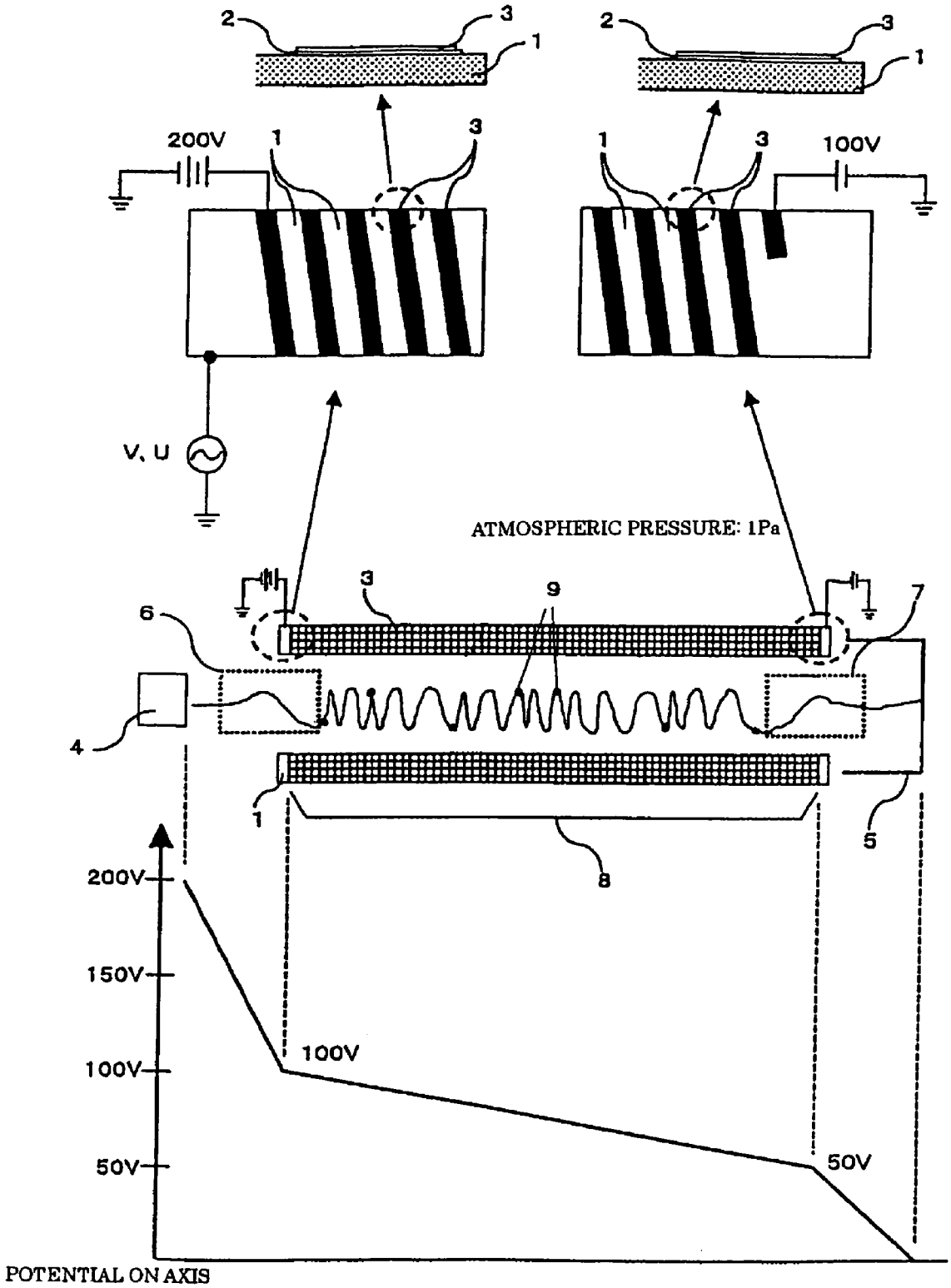
FIG. 1 is a schematic diagram for explaining a first embodiment of the present invention.

FIG. 1 is a schematic diagram for explaining a first embodiment of the present invention. The Q-pole type mass spectrometer which will be described in this embodiment can be actuated in a high-pressure atmosphere and is capable of measuring high-mass molecules with a high sensitivity. Control of motion of an ion to be measured in the Q-pole region in the axial direction is carried out by Coulomb force generated by an electric field formed by four Q-poles composing a Q-pole type mass spectrometer. Each Q-pole of the four Q-poles has different DC potentials at respective positions in the axial direction, while they have an equal DC potential except DC voltage U at the same position in the axial direction of each Q-pole of the four Q-poles.

The basic structure of the Q-pole type mass spectrometer of the present embodiment is the same as a conventional one, so that description thereof is omitted. The length of a Q-pole 1 can be designed 100 to 300 mm like the conventional Q-pole type mass spectrometer.

The Q-pole type mass spectrometer of this embodiment is different from the conventional one in that a spiral-like resisting thin film 3 is formed on the surface of the Q-pole 1. An insulating thin film 2 is sandwiched between the resisting thin film 3 and the surface of the Q-pole 1. A portion indicated by reference numeral 8 in FIG. 1 is a position at which the resisting thin film 3 is formed.

According to this embodiment, the width of the resisting thin film 3 is substantially the same as the width of foundation exposed surface (places without the thin film 3 at which the surface of the Q-pole 1 is exposed). A DC potential of 200 V is applied to an entrance of the resisting thin film 3 and DC potential of 100 V is applied to an exit thereof.

The four Q-poles 1 have the same structure, so that the potential in the Q-pole 1 decreases at a specified rate along the axial direction, that is, from the entrance to the exit. For this reason, an electric field is formed along the axis of the Q-pole 1 in a direction in which the ion advances with respect to the axial direction, so that a Coulomb force is applied to the ion, the ion thereby being accelerated.

According to this embodiment, 200 V is applied to an ion source 4 and 0 V is applied to a collector 5.

On the other hand, V, U voltages are applied to the Q-pole 1 like the conventional Q-pole type mass spectrometer. The DC potential is 0 V. Thus, with respect to the diameter direction, a quadrupole electric field is formed by the V, U voltages from the foundation exposed face (the places without the thin film 3 at which the surface of the Q-pole 1 is exposed). But, the entire potential of the quadrupole electric field is changed depending on the position of the Q-pole in the axial direction, since the DC currents from the resisting thin film 3 are overlaid (multiplexed) according to the addition principle of an electric field.

Thus, the ion is accelerated in the axial direction and mass is separated in the diameter direction. (In this embodiment, the exposed face for the DC potential and V, U voltages is divided into halves, so that an absolute value of the electric field is half of that of the case where the entire face is exposed for V, U voltage).

In this embodiment, the pressure of atmospheric gas is about 1 Pa, which greatly exceeds the limit of a case where the conventional Q-pole type mass spectrometer is used.

Under this pressure, the mean free path of the ion is within 10 mm, so that the ion always collides with atmospheric gas in the Q-pole 1. For this reason, the ion is temporarily decelerated in the axial direction just after it collides as shown by reference numeral 9 in FIG. 1. However, in the Q-pole type mass spectrometer of this embodiment, the ion is accelerated by the aforementioned Coulomb force immediately. The accelerated ion collides with the atmospheric gas and the deceleration and acceleration are repeated, so that the ion advances at a speed that is not so high in the Q-pole 1.

The collision occurs 20 times or more in the Q-pole 1 having a difference of 50 V between both ends thereof according to this embodiment. Thus, for example, the advance speed of an ion having the same mass as that of atmospheric gas reaches 2.5 eV (=50/20) maximum so that mass separation is sufficiently carried out.

The deceleration degree is small for a heavy ion. But the advance speed of the heavy ion can be suppressed to a low speed by decreasing the voltage gradient or increasing the mass of the atmospheric gas.

On the other hand, in an entrance fringing region 6 having a length of about 5 mm shorter than the mean free path, most ions pass at a speed as high as 100 eV without collision. Thus, none of the bad influence of fringing is produced. An ion, which passes the exit fringing region 7 at 50 eV, is detected by the collector 5.

As described above, the Q-pole type mass spectrometer of this embodiment can be actuated in a high pressure atmosphere and measure high-mass molecules with a high sensitivity.

As a modification of this embodiment, the same operation can be carried out by making the area of the resisting thin film 3 on the surface of the Q-pole 1 sufficiently larger than the foundation exposed face or forming the entire face of the Q-pole 1 with the thin film 3, and at the same time, overlaying (multiplexing) V voltage and U voltage on the thin film 3 in addition to the DC potential.

Second Embodiment

Figure 2:
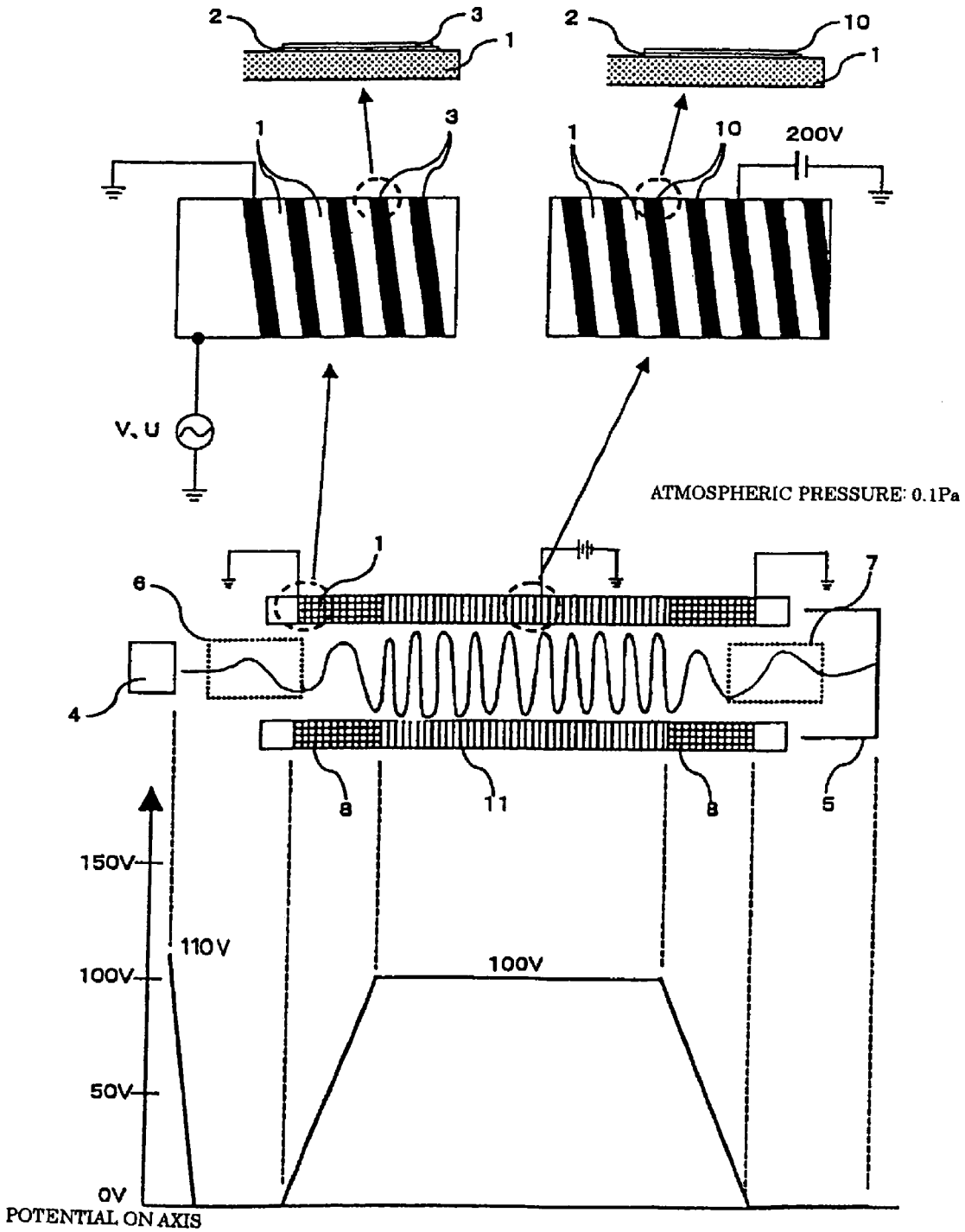
FIG. 2 is a schematic diagram for explaining a second embodiment of the present invention.

FIG. 2 is a schematic diagram for explaining a second embodiment of the present invention. The Q-pole type mass spectrometer which will be described in this embodiment is capable of measuring high-mass molecules with a high sensitivity. Control of motion of ions to be measured in the Q-pole region in the axial direction is carried out by Coulomb force generated by an electric field formed by four Q-poles composing the Q-pole type mass spectrometer. Each Q-pole of the four Q-poles has different DC potentials at respective positions in the axial direction, while they have an equal DC potential except DC voltage U at the same position in the axial direction of each Q-pole of the four Q-poles.

The Q-pole type mass spectrometer of this embodiment is different from that of the first embodiment only in that a conductive thin film 10 is added to the Q-pole 1, the voltage application condition is different, and that the pressure of the atmospheric gas is less than 0.1 Pa. The other parts and conditions are the same as those of the first embodiment.

In the Q-pole type mass spectrometer of this embodiment, the conductive thin film 10 is formed spirally in the center of the Q-pole 1, with an insulating thin film 2 interposed between the film 10 and the surface of the Q-pole 1. On both ends of the Q-pole 1, the resisting thin film 3 is formed spirally with the insulating thin film 2 interposed between the surface of the Q-pole 1. In FIG. 2, portions indicated by reference numerals 8 are portions at which resisting thin film 3 is formed spirally. Portions indicated by reference numeral 11 are portions at which the conductive thin film 10 is formed spirally. 200 V is applied to the conductive thin film 10 in the center and 0 V is applied to both the extreme ends of the resisting thin film 3. 110 V is applied to the ion source 4 and 0 V is applied to the collector 5.

In the resisting thin film formed portion 8 near the entrance on the left side of FIG. 2, the potential in the Q-pole 1 increases at a specified rate in the axial direction, that is, from the entrance up to a place where the conductive thin film 10 is formed, conversely to the case of the above described first embodiment. For this reason, an electric field opposite in direction to the direction of ion advancement is formed on the axis in the Q-pole 1, so that the Coulomb force acts on the ion from the opposite direction, whereby the ion is decelerated.

At the resisting thin film formed portion 8 near the entrance, an ion which has passed the entrance fringing portion 6 at a speed as high as 110 eV without being badly affected by fringing is decelerated up to 10 eV, which is a speed at which mass separation can be achieved, by an electric field inverse to the advancement direction.

In the Q-pole type mass spectrometer of this embodiment, most ions advance at a speed as low as 10 eV in the center without colliding with the atmospheric gas, because the pressure is less than 0.1 Pa.

Under the conditions such as are usually used, if the ion speed is decelerated to less than 20 eV, mass separation can be achieved.

The ion that reaches the resisting thin film formed portion 8 near the exit on the right side of FIG. 2 is accelerated by an electric field in the advancement direction, like the previously described embodiment 1, so that it passes an exit fringing portion 7 at a speed as high as 100 eV and is detected by the collector 5.

Therefore, in the center portion, sufficient mass separation is carried out without being subjected to the bad influence of the fringing portion. Thus, a high-mass molecule can be measured with a high sensitivity.

A modification of this embodiment can be actuated in a high pressure atmosphere of about 1 Pa if the thin film portion in the center is formed of the resisting thin film 3, like the first embodiment, so as to provide a potential gradient.

Third Embodiment

Figure 3A:
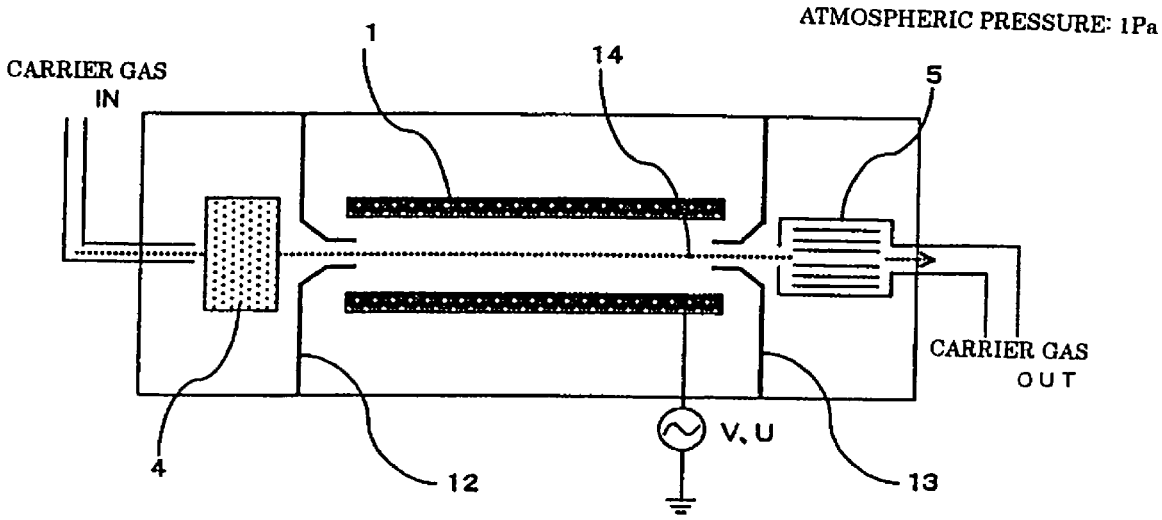
FIG. 3(*a*) is a schematic diagram for explaining the structure of a third embodiment of the present invention, and FIG. 3(*b*) is a diagram showing the motion of an ion in the embodiment of FIG. 3(*a*).
Figure 3B:
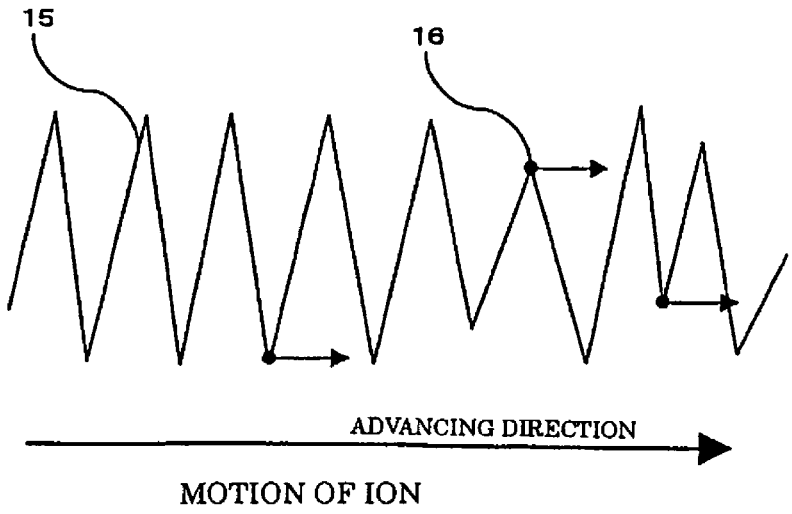

FIG. 3(*a*) is a schematic diagram for explaining a third embodiment of the present invention. The Q-pole type mass spectrometer which will be described in this embodiment can be actuated in a high-pressure atmosphere and controls the motion of an ion to be measured in the Q-pole region in the axial direction by a reaction force generated by a collision between the ion to be measured and the atmospheric gas.

The Q-pole type mass spectrometer of this embodiment has the same structure as the conventional Q-pole type mass spectrometer except that the ion source 4 and the collector 5 are so constructed that gas passes through them and a carrier gas flows therein.

The pressure of the atmospheric gas as the carrier gas is about 1 Pa. The carrier gas flows in the Q-pole in the direction of ion advancement as indicated by reference numeral 14.

In the Q-pole type mass spectrometer of this embodiment, the ion receives a reaction force each time it collides with the carrier gas, so that a path 15 of the ion advances along a flow of the carrier gas with repeated collisions and stops as indicated by reference numeral 16, as shown in FIG. 3(*b*).

That is, an ion generated in the ion source 4 enters the Q-pole region with the flow of the carrier gas and advances at a speed lower than 20 eV, which is a speed capable of achieving mass separation, in the axial direction. Then, mass separation is carried out by the quadrupole electric field in the diameter direction.

In the Q-pole type mass spectrometer of this embodiment, by employing an entrance electrode 12 and an exit electrode 13 each having a narrow nozzle as shown in FIG. 3(*a*), distortion of the electric field in the fringing region is reduced and the flow speed of the carrier gas in the fringing region is increased, so as to reduce the bad influence of the fringing problem.

Fourth Embodiment

Figure 4:
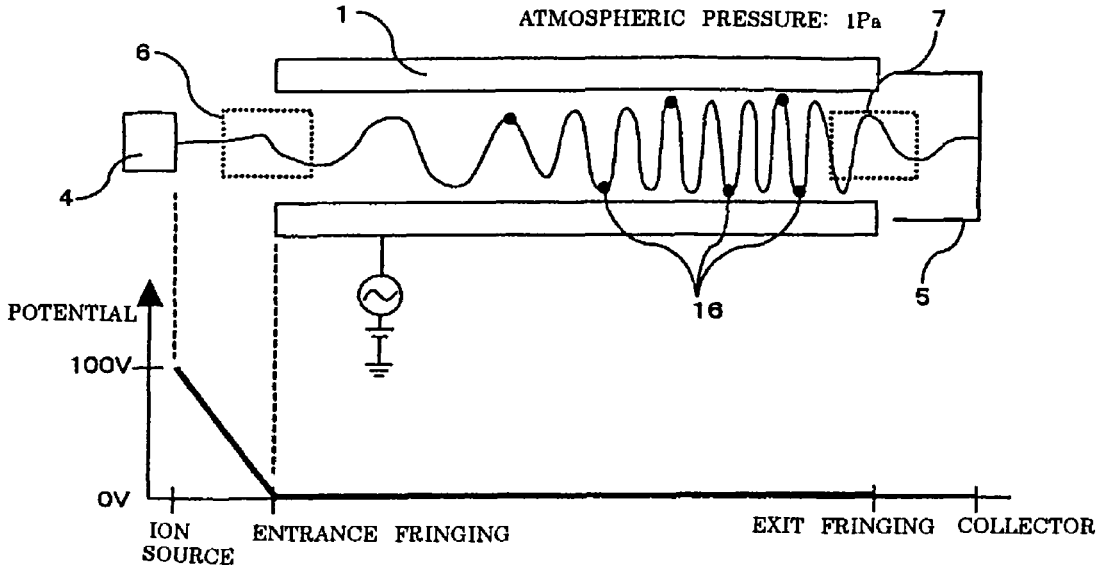
FIG. 4 is a schematic diagram for explaining a fourth embodiment of the present invention.

FIG. 4 is a schematic diagram for explaining a fourth embodiment of the present invention. The Q-pole type mass spectrometer which will be described in this embodiment can be actuated in a high-pressure atmosphere and is capable of measuring a high-mass molecule with a high sensitivity. Control of motion of an ion to be measured in the Q-pole region in the axial direction is carried out by setting conditions of the length of the Q-pole, the kind and pressure of the atmospheric gas, the potential of the ion source and the potential of the Q-pole on the axis.

The Q-pole type mass spectrometer of this embodiment is the same as the conventional one except for the DC voltage applied to the ion source 4, the length of the Q-pole, the kind and pressure of the atmospheric gas and the potential of the Q-pole on the axis. More specifically, the ion source 4 has 60 V, the length of the Q-pole is 200 mm, the atmospheric gas is He of 1 Pa and the potential of the Q-pole 1 on the axis is 0 V. For example, He charged in a cylinder is introduced into a pressure reduced atmosphere through a flow rate variable valve so as to maintain a He pressure of 1 Pa.

In the Q-pole region, an ion collides with He in the atmospheric gas, so that, as indicated by reference numeral 16 of FIG. 4, the ion is decelerated while repeating collisions and stops. At the initial phase in the entrance fringing region 6, in which collisions do not occur so often, the ion moves too fast. At the final stage in the exit fringing region 7 after a number of the collisions have occurred, the speed of the ion remains so that the ion reaches the collector 5 and is detected thereby.

But, He or $H_2$ ions, having the same or smaller mass than He of the atmospheric gas, are stopped completely or returned by the collisions. Thus, according to this embodiment, a gas having the same or smaller mass than the atmospheric gas cannot be measured in principle, but a gas of the same or larger mass than the atmospheric gas can be measured.

To achieve this action, respective conditions such as the length of the Q-pole 1, the kind and pressure of the atmospheric gas and the potential of the ion source 4 and the Q-pole on the axis have to satisfy a certain relation. That is, if the ion speed is too fast, mass separation is impossible, and if it is too slow, the ion can not reach the collector 5. Its necessary condition is obtained from an equation of a geometric series, with a reduction rate obtained from an equation $\{V_2=V_1(M_i-M_g)/(M_i+M_g)\}$ of speed change before and after a collision as a common ratio. However, upon calculation, it must be noticed that the vibration in the diameter direction is included in the mean free path of the ion.

In practical use, many kinds of gases or ions each having a largely different mass are measured, and thus it is difficult to determine the strictly necessary conditions.

However, with the conditions of this embodiment, it is possible to satisfy necessary vibration frequencies for a wide range of 10 to 500 amu so as to achieve proper mass separation.

More specifically, with the conditions of this embodiment as described, the vibration frequency necessary for the above-mentioned proper mass separation is satisfied so that about 40 times is satisfied under 50 amu, about 60 times under 100 amu, and about 110 times under 300 amu. In this Q-pole, appropriate deceleration is achieved so that collisions occur about 5 times under 50 amu, about 15 times under 100 amu and about 50 times under 100 amu.

Further, according to this embodiment, ion passes the entrance fringing region 6 at a speed as high as 60 eV, so that little of the bad influence of the fringing problem occurs, thereby making it possible to measure high-mass molecules with a high sensitivity. As the speed of an ion passing the entrance fringing region 6 increases, the possibility that it may be affected by the bad influence of the fringing problem decreases. If it is set that an ion passes the entrance fringing region 6 at a speed higher than 30 eV, the ion receives little of the bad influence of the fringing problem.

If the gas to be measured is limited to a small mass range, it is possible to optimize conditions so as to improve resolution. If the atmospheric gas is Ar of 0.1 Pa, an ion collides about 50 times around 300 amu and the vibration frequency reaches about 250 times.

Fifth Embodiment

Figure 5:
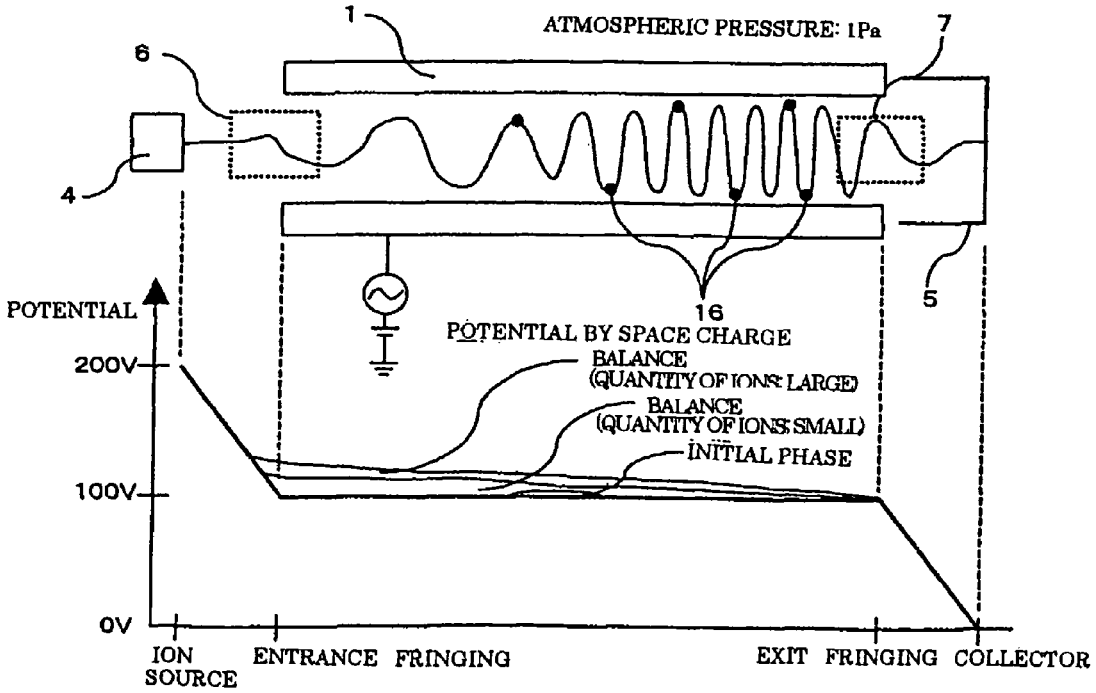
FIG. 5 is a schematic diagram for explaining a fifth embodiment of the present invention.

FIG. 5 is a schematic diagram for explaining a fifth embodiment of the present invention. The Q-pole type mass spectrometer which will be described in this embodiment can be actuated in a high-pressure atmosphere and is capable of measuring high-mass molecules with high sensitivity. Control of motion of an ion to be measured in the Q-pole region in the axial direction is carried out with Coulomb force generated by space charge formed in the Q-pole region by the ion to be measured.

The Q-pole mass spectrometer of this embodiment is the same as the conventional Q-pole mass spectrometer except for the DC voltage applied to each of the ion source 4, Q-pole 1 and collector 5.

More specifically, 200 V is applied to the ion source 4, 100 V is applied to the Q-pole 1 and 0 V is applied to the collector 5. Consequently, as shown in FIG. 5, the potential on the axis in the Q-pole region is lower than the potential on the axis in the entrance fringing region and higher than the potential on the axis in the exit fringing region.

Any kind and pressure of the atmospheric gas are permitted if the ion is stopped finally in the Q-pole region by collisions. A pressure slightly higher than the pressure of the atmospheric gas employed in the above-described embodiment can be considered and for example, the pressure of He can be set to 10 Pa.

In the Q-pole mass spectrometer of this embodiment, the ion is stopped and sojourns in the Q-pole region by collisions with the atmospheric gas. If the injection of the ion is continued, a potential by its own charge or a potential by a space charge is successively formed. In the initial condition, a hill-like space charge (potential) is formed around a place where the ion is stopped and sojourns.

If the foot of the hill of the space charge (potential) reaches both fringing regions after injection of the ion is continued, the shape of the space charge (potential) begins to change to a slide having a downward gradient in a direction in which the ion should advance. This reason is that while an ion reaching the exit fringing region 7 flows out to the side of the collector 5 by the electric charge on the axis directed outward by the collector potential, an ion reaching the entrance fringing region 6 sojourns in the Q-pole by an electric charge directed inward (rightward in FIG. 5) by the potential of the ion source.

Although the ion is restricted by vibration in the diameter direction, in the initial condition under which the slide-shaped space charge (potential) has not been formed, the ion is not restricted by anything in the axial direction, so that it is capable of moving freely on the axis. Therefore, ions are distributed at a balance with their own electric charge.

Under the slide-shaped space charge (potential), the ion receives Coulomb force in the forward direction with respect to the axis direction. Thus, after an ion injected into the Q-pole 1 is decelerated and stopped by a collision with the atmospheric gas, it is accelerated again by this Coulomb force, so that it passes the Q-pole 1 while it is subjected to mass separation, and then it is detected by the collector 5.

Although Coulomb force by space charge is applied in the diameter direction, this is not a problem for measurement, because the speed component of several eV in the diameter direction is allowed due to the operating principle of the quadrupole type mass spectrometer. In this embodiment, the ion does not receive any influence due to the fringing problem because it passes the entrance fringing region 6 at a speed as high as 100 eV.

Sixth Embodiment

Figure 6:
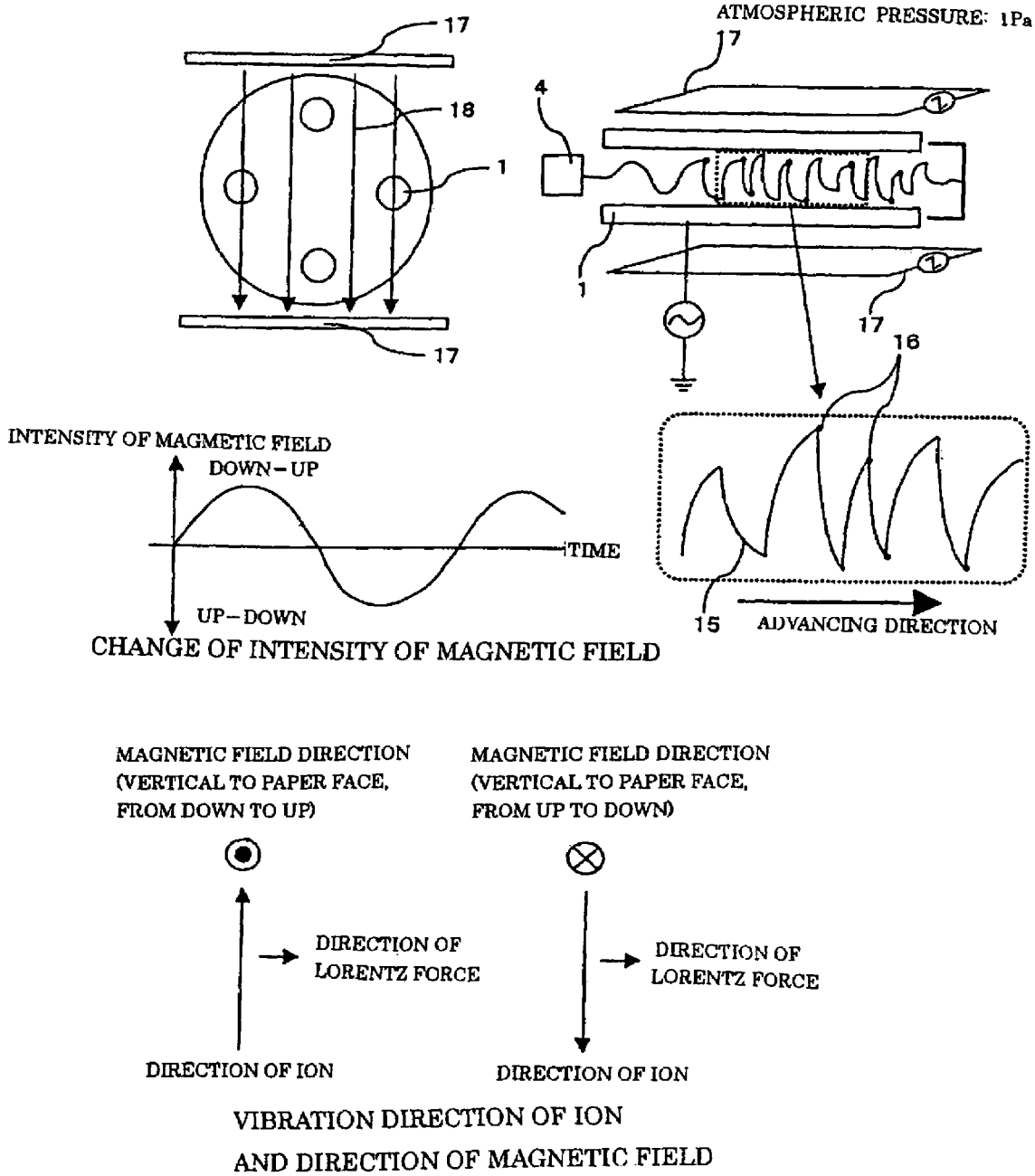
FIG. 6 is a schematic diagram for explaining a sixth embodiment of the present invention.

FIG. 6 is a schematic diagram for explaining a sixth embodiment of the present invention. The Q-pole type mass spectrometer which will be described in this embodiment can be actuated in a high-pressure atmosphere. Control of motion of an ion to be measured in the Q-pole region in the axial direction is carried out by a Lorentz force generated by high-frequency magnetic field synchronous with the quadrupole high-frequency electric field applied in the diameter direction.

The Q-pole type mass spectrometer of this embodiment is the same as the conventional Q-pole type mass spectrometer except that coils 17 for generating a magnetic field are disposed above and below the Q-poles 1.

The magnetic field generated from the coils 17 is formed such that magnetic force lines 18 are directed vertically with respect to the diameter direction in the Q-pole region. Thus, ions vibrating in the right and left direction with respect to the diameter direction intersect the magnetic force lines 18, so as to produce a Lorentz force in the axial direction. The magnetic field is a high-frequency frequency magnetic field whose direction changes rapidly and the phase of the high frequency is synchronous with the V voltage applied to the Q-pole 1. Thus, each time when an ion reciprocates by vibration, the direction of the magnetic field changes so that the direction of the Lorentz force applied to ion vibrating in the same phase is always constant.

Therefore, after the ion is decelerated and stopped by a collision with the atmospheric gas shown by reference numeral 16, it passes the Q-pole region receiving a forward force while it is subjected to mass separation.

Although the vibration phase of half the ions is of the same phase as the V voltage, the remaining ions have the opposite phase. Thus, only half of the ions advance and are measured properly while the remaining half of the ions retract. However, this is no problem in measurement.

Practically, there is a deviation of the phase between an ion and the magnetic field, so that is preferable to adjust to an optimum phase by providing a phase converter. Further, it is preferable to adjust the direction and frequency of the coil to optimum ones, since the vibration frequency of an ion differs depending on the vibration direction.

A bad influence of the magnetic field on mass separation begins to occur from 200 Gauss, and its resolution is deteriorated to one half at 300 Gauss. Therefore, the size of the magnetic field to be applied is preferred to be within 200 Gauss.

If an indispensable condition exists that the pressure of the atmospheric gas is high, the voltage of the ion source 4 is raised to 60 to 200 V so as to allow ions to pass the entrance fringing region 6 rapidly, and a high-mass molecule can be measured with a high sensitivity.

Seventh Embodiment

Figure 7:
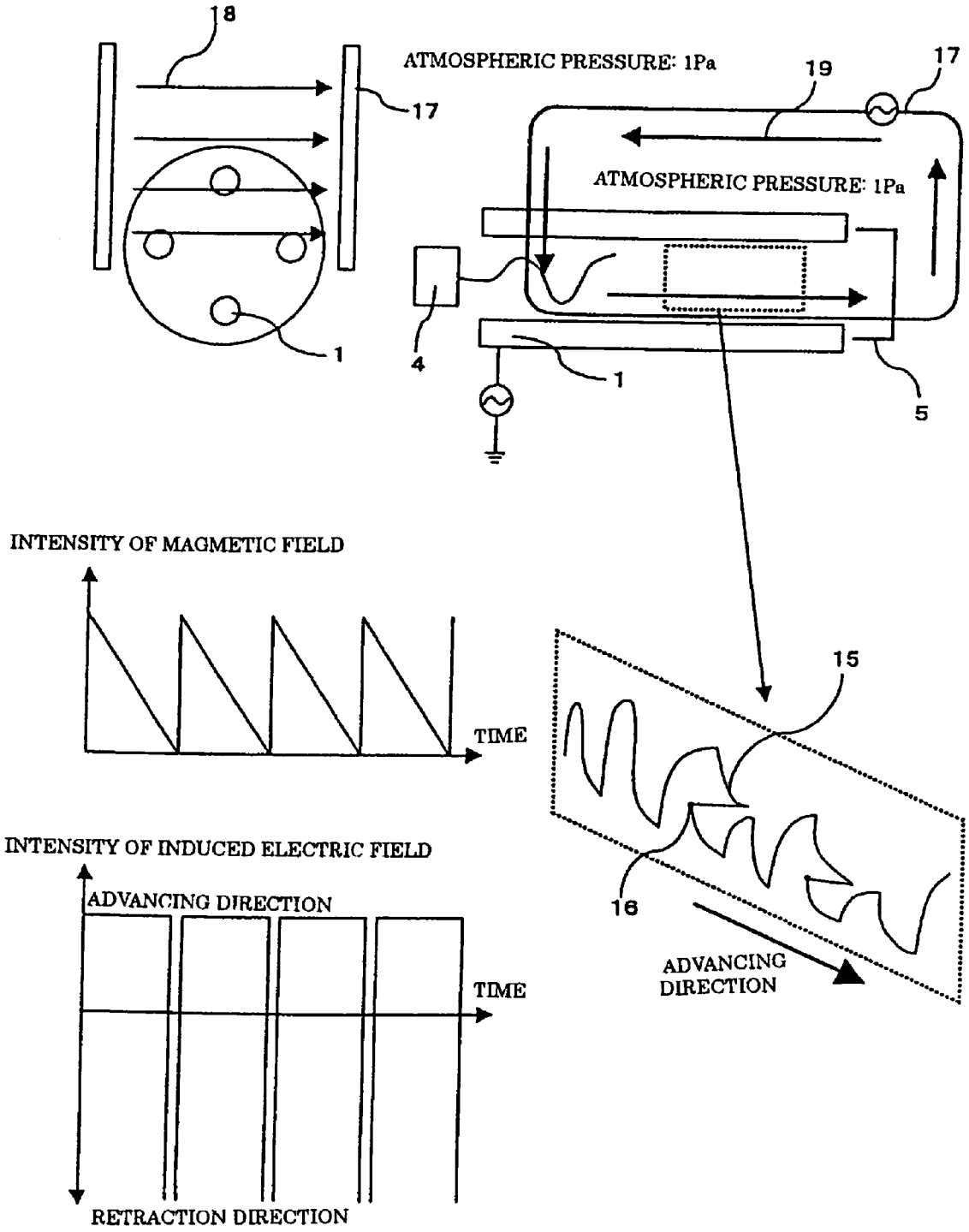
FIG. 7 is a schematic diagram for explaining a seventh embodiment of the present invention.

FIG. 7 is a schematic diagram for explaining a seventh embodiment of the present invention. The Q-pole type mass spectrometer of this embodiment can be actuated in a high-pressure atmosphere. Control of the motion of an ion to be measured in the Q-pole region in the axial direction is carried out by an electromagnetic induction force generated by a magnetic field changing in its intensity with the passage of time, applied in the diameter direction.

The Q-pole type mass spectrometer of this embodiment is the same as the conventional one, except that coils 17 for generating the magnetic field are disposed slightly above the right and left positions of the Q-pole 1.

The magnetic field from the coils 17 is formed such that the magnetic force lines 18 are directed in the diameter direction in the Q-pole region. The magnetic field is a sawtooth shaped magnetic field which repeats a quick increase and slow damping, so that an electromagnetic induction force 19 generated by the magnetic field changing in its intensity with the passage of time is applied to the ions. This electromagnetic induction force is known as the phenomenon of eddy current generated in a conductive plate on which an AC electric field is applied.

As an ion in the Q-pole can move freely in the axial direction, it receives a force in the axial direction by an electromagnetic induction force.

The direction of the electromagnetic induction force by the slow damping is forward, so that an ion receives a force in the forward direction for a long time so that it advances along a long path. On the other hand, the electromagnetic force generated by the quick increase in the opposite direction is not applied for a long time, so that the actual path in the opposite direction is short. This reason is that although any path for advance and retraction is given by a product of the mean free path and the number of collisions, the number of collisions is larger in the forward direction.

Although the collision speed (energy) is larger in the case of retraction, it does not contribute to an increase of the path which is lost by the collision. Thus, on average, the ion always receive a force in the forward direction.

Then, the ion generated from the ion source 4 is decelerated and stopped by a collision with the atmospheric gas as shown by reference numeral 16 and receives a force in the forward direction by the electromagnetic induction force 19. After the ion passes a path indicated by reference numeral 15, it passes the Q-pole region while it is subjected to mass separation and then reaches the collector 5.

According to this embodiment, the direction, frequency and phase of the magnetic field may be arbitrary.

If an indispensable condition exists that the pressure of the atmospheric gas is high, the voltage of the ion source is raised to 60 to 200 V so as to allow the ion to pass the entrance fringing region at high speed, and a high-mass molecule can be measured with a high sensitivity.

Eighth Embodiment

Figure 8A:
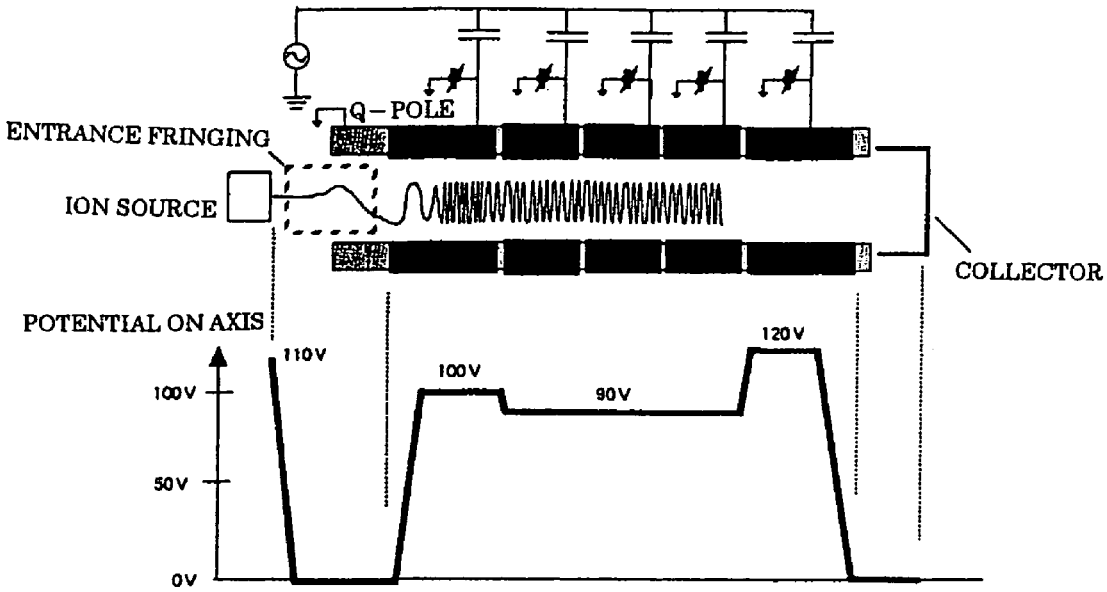
FIG. 8(*a*) is a schematic diagram for explaining an accumulation mode of an eighth embodiment of the present invention, and FIG. 8(*b*) is a schematic diagram for explaining a detection mode the eighth embodiment of the present invention.
Figure 8B:
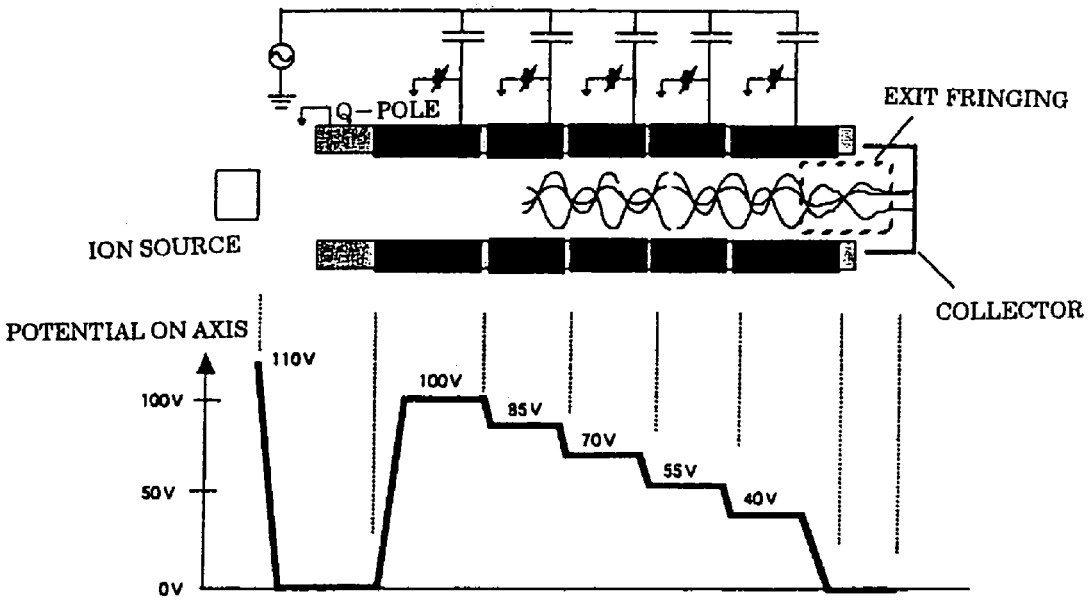
Figure 9:
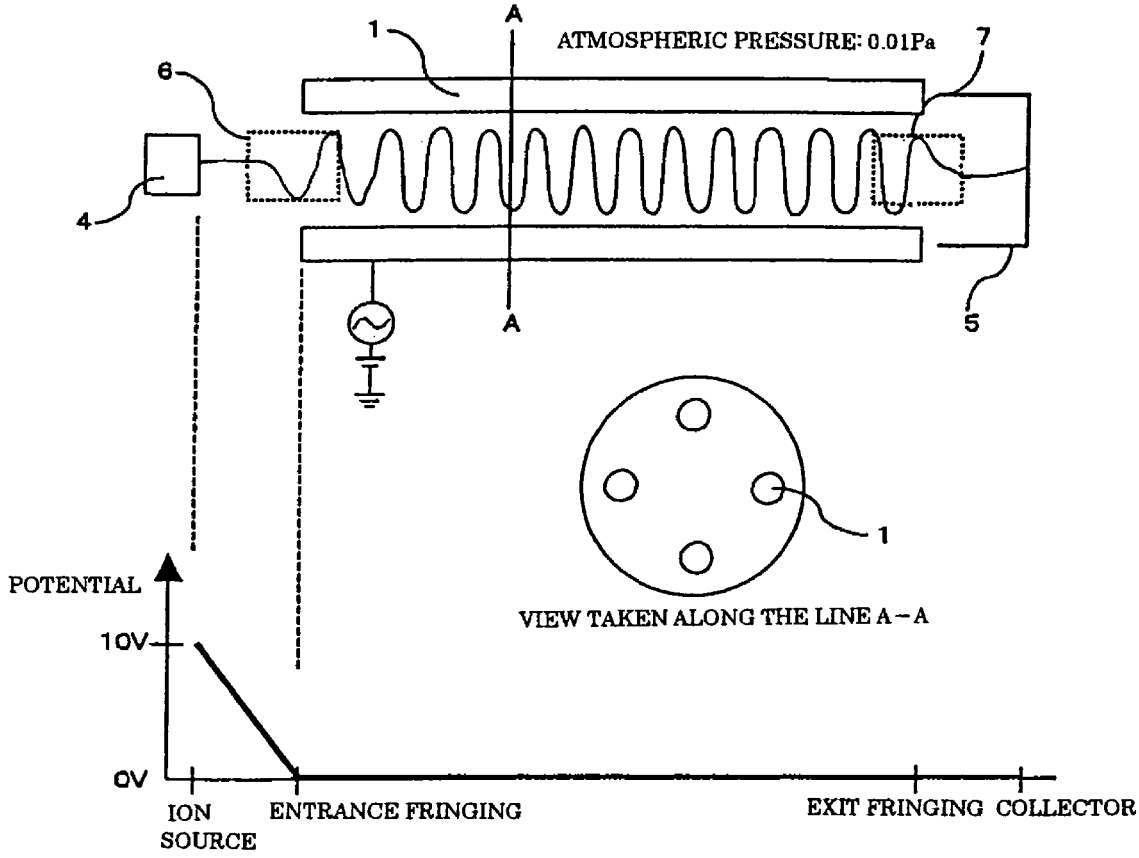
Fig.9(prior art)
FIG. 9 is a schematic diagram for explaining a conventional Q-pole type mass spectrometer under an atmospheric pressure of less than 0.01 Pa.
Figure 10:
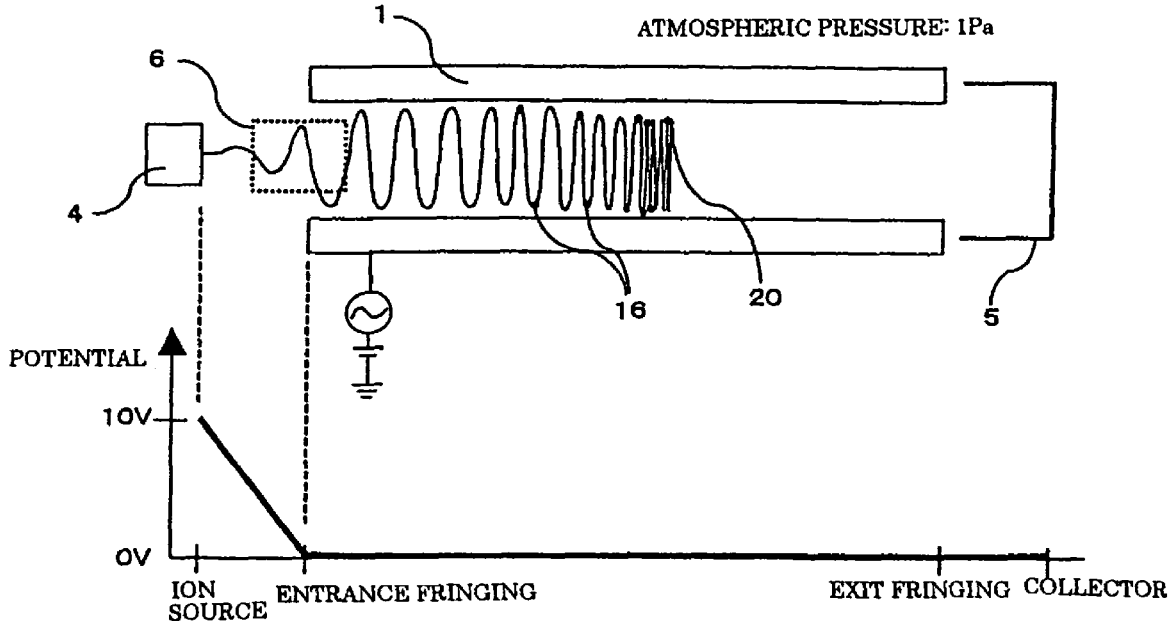
Fig.10(prior art)
FIG. 10 is a schematic diagram for explaining the conventional Q-pole type mass spectrometer under an atmospheric pressure of about 1 Pa.

FIG. 8 is a schematic diagram for explaining an eighth embodiment of the present invention. The Q-pole type mass spectrometer which will be described in this embodiment can be actuated in a high-pressure atmosphere and is capable of measuring an ultra-small amount of gas. Control of motion of an ion to be measured in the Q-pole region in the axial direction is carried out by Coulomb force generated by an electric field formed by four Q-poles composing the Q-pole type mass spectrometer, constructed so that each Q-pole of the four Q-poles has different DC potentials at respective positions in the axial direction, while they have an equal DC potential except DC voltage U at the same position in the axial direction of each Q-pole of the four Q-poles.

Five groups of conductive thin films are provided on the Q-pole. These conductive thin films cover the entire surface of the Q-poles so that there is no exposed foundation face. Independent and variable DC voltage and common V, U voltages are applied to each of these conductive thin films, respectively. The potential on the axis of the Q-pole is 0 V while 110 V is applied to the ion source and 0 V is applied to the collector. The structure of the Q-pole type mass spectrometer of this embodiment is the same as the case of the second embodiment except for these points. Meanwhile, the pressure of the atmospheric gas is set to 1 Pa.

The Q-pole type mass spectrometer of this embodiment has an accumulation mode and a detection mode. The DC potential to be applied to the conductive thin film differs depending on the mode. In the accumulation mode, an ion of a specific gas (an ultra-small amount of gas) is accumulated and other ions are removed. In the detection mode to be executed intermittently, an ion of a condensed specific gas (an ultra-small amount of gas) is detected.

In the accumulation mode shown in FIG. 8(*a*), a DC potential of 100 V, 90 V, 90 V, 90 V and 120 V are applied to the conductive thin film from an end of the Q-pole (near the ion source). That is, there is no potential gradient in the Q-pole and potentials near both ends in the Q-pole are higher. Thus, ions generated by the ion source pass the entrance fringing region at a speed as high as 110 eV, and after that are decelerated in the Q-pole region, so that mass separation is carried out. However, because the concentration of specific gas (an ultra-small amount of gas) to be measured is low, the quantity of ions of the specific gas subjected to mass separation is very small. Thus, even if the ion is injected from the Q-pole region in the direction to the collector, it is buried in background noise so that it cannot be detected as a signal.

In the Q-pole type mass spectrometer of this embodiment, there is no potential gradient in the Q-pole, so that ion repeating the collision with the atmospheric gas loses motion in the axial direction finally, and it is stopped completely. But, ions are injected into the Q-pole successively from the ion source, and therefore ions of the specific gas are accumulated near the center, so that the concentration thereof is increased over time, or ions are condensed. A repulsive force by space potential is applied to the condensed ions. As the potential is high near both ends in the Q-pole, the ions continue to be collected near the center in the Q-pole. That is, ions of the specific gas to be measured sojourn in the Q-pole.

After the accumulation of ions is carried out for a predetermined time so that the ions of the specific gas to be measured sojourn in the Q-pole region, the detection mode is selected.

When the detection mode shown in FIG. 8(*b*) is selected, DC potentials of 100 V, 85 V, 70 V, 55 V and 40 V are applied to the conductive thin film from an end of the Q-pole (near the ion source). Although the potential on the surface of the Q-pole is gradual, a continuous potential gradient is formed by relaxation of the space charge on the axis and the potential change. Thus, ions of the specific gas accumulated near the center in the Q-pole are injected from the Q-pole toward the collector so that they are detected by the collector as an electric signal.

Ions are injected from the Q-pole at least less than $10^{-3}$ seconds. Thus the amount of signals detected at that time becomes larger than usual by more than $10^3$, and therefore the influence of background noise can be omitted. However, although the background noise can be omitted, the amount of signals obtained by measurement often becomes insufficient, and therefore the detection mode is actuated intermittently so as to increase the amount of signals. That is, when operating, the accumulation mode is activated for a second, and the detection mode, which is executed intermittently, is activated for $10^{-3}$ seconds. Then, by repeating this cycle, data processing is carried out so as to execute addition.

Thus, according to the Q-pole type mass spectrometer of this embodiment, an ultra-small amount of gas, which cannot be measured by an ordinary method, can be measured.

If a signal is buried in the background noise in every measurement, the signal cannot be recognized as a signal even if addition by data processing is repeated. Thus, the operating time setting in the accumulation mode is determined based on the fact that the signal increases at least more than the same level as the background noise.

According to this embodiment, a conductive thin film which can cover the entire face of the Q-pole is employed as a thin film. The resisting thin film and spiral shaped thin film may be used like the first and second embodiments. The resisting thin film may be actuated under a higher pressure atmosphere by relaxing a quick change of the potential so as to reduce the disturbance of the ions or providing a potential gradient. Although the spiral-like thin film has an advantage in that the V, U voltage only has to be applied to a single position, high level thin film production technology is required. Meanwhile, it is permissible to use a Q-pole divided into plural segments without using any thin film, although it is difficult to secure its accuracy.

Although the preferred embodiments of the present invention have been described with reference to the accompanying drawings, the present invention is not restricted to these before described embodiments, but the present invention may be modified in various ways within the technical scope grasped by a description of claims of the present invention.

For example, the motion of an ion in the axial direction within the Q-pole region can be controlled by executing the control methods for the motion of the ion in the axial direction within the Q-pole region described in the above respective embodiments independently, as well as by executing the control methods for the motion of the ion in the axial direction within the Q-pole region described in the above respective embodiments in combination.

According to the present invention, the motion of an ion to be measured is controlled within the Q-pole region by various methods in the axial direction, which is independent of the motion of the ion in the diameter direction. Mass separation under a high-pressure condition of more than 0.1 Pa is thereby enabled and continuous mass analysis of gas molecules is also enabled.

Also, according to the present invention, influences due to the fringing problem can be reduced, and a high-mass gas can be measured with a high sensitivity. Further, an ultra-small amount of gas can be measured by condensing a specific ion.

According to the present invention for controlling the motion of ions in the axial direction, the following three effects can be obtained.

1) High-voltage action,
2) Reduction of any influence due to the fringing problem, and
3) Condensation of a specific ion.

These three effects have a very close relationship with each other. Thus, to secure one or two of these, or three at the same time, the embodiments described in this specification may be combined by modifying them.

For example, to obtain the effects of the aforementioned 1) and 2) at the same time, 200 V is applied to the ion source 4, in the first embodiment, so as to allow the ion to pass the entrance fringing region at a speed as high as 100 eV. However, it is permissible to allow the ion to pass the entrance fringing region at the same speed of 10 eV as conventionally by applying 110 V to the ion source 4. In this case, although the effect of 2) is lost, the mechanical and electrical load on the ion source is reduced while the effect of 1) is maintained.

In the eighth embodiment, the effects of the aforementioned 1), 2) and 3) are obtained at the same time and the operating pressure is 1 Pa, while the potential near the center of the Q-pole is 90 V. However, the operating pressure may be less than 0.1 Pa and the potential near the center of the Q-pole may be 99 V, which is near the potential (100 V) at an end (near the ion source) of the Q-pole. In this case, although the effect of the above 1) is lost, the effects of the aforementioned 2) and 3) are maintained. Even if the effect of 1) is eliminated, a large advantage, in that the necessity of the pressure control is eliminated, can be obtained if this embodiment is used for the specific application.

In the first embodiment, a constant voltage of 100 V is applied to the exit side of the resisting thin film 3 and the effect of the aforementioned 3) does not exist. However, if this voltage is set to 200 V for a second and 100 V for 0.001 seconds repeatedly, the effect of 3) can be obtained.

Although the length of the Q-pole is 100 to 300 mm, like the conventional Q-pole type mass spectrometer, in all of the above described embodiments in this specification, the present invention is not restricted to this length. Although the length of the Q-pole is indispensable for obtaining a sufficient vibration frequency in the conventional Q-pole type mass spectrometer, according to the present invention, it can be reduced to less than 100 mm if an appropriate condition is selected. Particularly in other embodiments than the third and fourth embodiments of the present invention, the speed of an ion in the axial direction within the Q-pole region can be controlled freely or the speed of an ion within the Q-pole region can be reduced sufficiently while the speed of the ion in the fringing region is kept high. Therefore, a high-mass molecule can be measured with a sufficiently high sensitivity, even with a Q-pole of 50 mm or less. Therefore, according to the present invention, it is possible to provide a small Q-pole type mass spectrometer using a Q-pole shorter than conventionally.

The conventional ultra small Q-pole type mass spectrometer capable of being actuated under a high-pressure atmosphere discussed as prior art in this specification requires strict accuracy of position because the interval of the Q-poles has to be smaller in proportion to the length thereof. This is an important problem for actual use.

According to the present invention, the interval of the Q-poles may be the same as conventionally, that is, the same accuracy of position as that of the conventional Q-pole type mass spectrometer may be accepted.

Further, because the length of the Q-pole may be reduced to part of that of the conventional Q-pole type mass spectrometer, the same accuracy of position can be achieved tremendously easily. The problem of the accuracy of position of the Q-pole, which is a serious obstacle in terms of performance and cost in the conventional Q-pole type mass spectrometer, can be solved by the present invention.

What is claimed is:

1. A Q-pole type mass spectrometer that is installed in a reduced pressure gas environment, wherein said Q-pole type mass spectrometer has a Q-pole region in which a high-frequency electric field is formed, said Q-pole type mass spectrometer is configured so that ions to be measured, having a predetermined linear energy, are injected into said Q-pole region from an ion source toward a collector, said Q-pole type mass spectrometer is configured so that the motion in an axial direction of the ions to be measured, advancing from said ion source to said collector, is controlled within the Q-pole region by generating force by which the ions to be measured accelerate in the Q-pole region from the ion source to the collector and by making the force continuously or intermittently act on the ions to be measured in the Q-pole region at the same time that the ions to be measured are subjected to mass separation in said Q-pole region by Coulomb force in the diameter direction generated by a quadrupole high-frequency field, said Q-pole type mass spectrometer is configured so that the control of the motion in the axial direction of the ions to be measured within said Q-pole region comprises using Coulomb force generated by an electric field formed by four Q-poles of said Q-pole type mass spectrometer, wherein said four Q-poles have equal DC potentials except for a DC potential U at the same position in the axial direction of each Q-pole of the four Q-poles, while each Q-pole of the four Q-poles has a different DC potential depending on the position in the axial direction, the four Q-poles have a resisting thin film formed thereon on at least part of the surfaces thereof such that the DC potential differs depending on the position of each Q-pole in the axial direction, and a high-frequency voltage V and DC voltage U are applied to the resisting thin film and the resisting thin film is formed spirally.

2. The Q-pole type mass spectrometer of claim 1, wherein an insulating thin film is formed between the resisting thin film and the surface of the Q-pole.

3. A Q-pole mass spectrometer, comprising:

four poles arranged to form a Q-pole region where a quadrupole high-frequency electric field is formed and having an axis extending in an axial direction, said four poles extending along the axis;

an ion source operable to emit ions to be measured into said Q-pole region; and a collector positioned to receive ions from said Q-pole region; wherein said four poles, said ion source and said collector are in a reduced pressure gas environment;

the Q-pole type mass spectrometer is configured so that ions to be measured having predetermined linear energy are injected into the Q-pole region where the quadrupole high-frequency electric field is formed, said four poles, said ion source and said collector, in said reduced pressure gas environment, incorporate means for controlling the motion in the axial direction of the ions to be measured, advancing from said ion source toward said collector in said Q-pole region, by generating force by which the ions to be measured in the Q-pole region accelerate from the ion source to the collector and making the force continuously or intermittently act on the ions to be measured in the Q-pole region, at the same time that the ions to be measured are subjected to mass separation in said Q-pole region by Coulomb force in the diameter direction generated by a quadrupole high-frequency field, said Q-pole type mass spectrometer is configured so that the control of the motion in the axial direction of the ions to be measured within said Q-pole region comprises using Coulomb force generated by an electric field formed by four Q-poles of said Q-pole type mass spectrometer, wherein said four Q-poles have equal DC potentials except for a DC potential U at the same position in the axial direction of each Q-pole of the four Q-poles, while each Q-pole of the four Q-poles has a different DC potential depending on the position in the axial direction, the four Q-poles have a resisting thin film formed thereon on at least part of the surfaces thereof such that the DC potential differs depending on the position of each Q-pole in the axial direction, and a high-frequency voltage V and DC voltage U are applied to the resisting thin film and the resisting thin film is formed spirally.

4. The Q-pole type mass spectrometer of claim 3, wherein an insulating thin film is formed between the resisting thin film and the surface of the Q-pole.

* * * * *